United States Patent [19]

Skeie

[11] Patent Number: 4,826,007

[45] Date of Patent: May 2, 1989

[54] TOOL BUCKET ORGANIZER

[76] Inventor: Gary Skeie, R.R. 1, Box 577, Highland Lakes, N.J. 07422

[21] Appl. No.: 192,599

[22] Filed: May 11, 1988

[51] Int. Cl.[4] ..... B65D 85/20; B65D 21/00

[52] U.S. Cl. ..... 206/373; 211/70.6; 220/85 D

[58] Field of Search ..... 206/372, 373; 211/70.6; 220/85 D, 85 R, 95, 410

[56] References Cited

U.S. PATENT DOCUMENTS

| | | | |
|---|---|---|---|
| 2,230,667 | 2/1941 | Nelson | 211/70.6 |
| 2,864,510 | 12/1958 | Sture | 220/85 R |
| 3,298,532 | 1/1967 | Wilcke | 211/70.6 |
| 4,362,243 | 12/1982 | Deyesso et al. | 206/373 |
| 4,460,085 | 7/1984 | Jantzen | 206/373 |
| 4,550,828 | 11/1985 | Baldwin et al. | 206/373 |
| 4,765,472 | 8/1988 | Dent | 206/373 |
| 4,768,652 | 9/1988 | Fallon | 206/373 |

FOREIGN PATENT DOCUMENTS

| | | | |
|---|---|---|---|
| 0705728 | 10/1963 | Canada | 220/85 R |
| 0418970 | 2/1967 | Switzerland | 220/85 R |

*Primary Examiner*—Jimmy G. Foster

*Attorney, Agent, or Firm*—Lerner, David, Littenberg, Krumholz & Mentlik

[57] ABSTRACT

A tool bucket organizer which is readily usable in conjunction with a tool bucket having a generally planar platform member to provide a flange-like configuration about the perimeter of the bucket and including a cylindrical aperture to provide access to the interior of the bucket, diametrically opposed slots for permitting the bail of the bucket to extend therethrough, and tool holding means for holding tools or materials about the perimeter of the bucket or within the interior of the bucket. The tool bucket organizer may also include a hingedly connected cover member to cover the platform member and an annular tool and material organizer to provide compartmentalized bins about the lower portion of the bucket and to provide stability therefor. The annular tool and material organizer can be integrally formed within the bucket, but is preferably fastened to the platform member to maintain the tool bucket organizer in assembled position.

12 Claims, 4 Drawing Sheets

TOOL BUCKET ORGANIZER

BACKGROUND OF THE INVENTION

This invention relates generally to tool carriers, and more particularly to a tool carrier adapted for use in connection with a pail or bucket.

It has generally been the practice of those in the construction industry to utilize empty pails or buckets, for instance five-gallon spackling buckets, for carrying larger tools and materials such as power saws or large pipe wrenches. This practice developed by reason of the large quantity of such pails or buckets being left at construction sites after the contents thereof, for instance spackle, were emptied therefrom. Thus, many contractors in the construction industry such as plumbers, carpenters, electricians and tilers, taking advantage of the large interior of such pails or buckets, appropriate these discarded pails or buckets for use as tool or material handlers.

While these pails or buckets are generally used for larger tools and materials, many smaller tools and materials find their way into the bucket where they are not easily retrieved from below the larger tools or materials. This occurs mainly because contractors will often select the smaller tools required for a particular job and place them in the bucket so that they need only carry the bucket to that particular job site, leaving other tool chests in their work vehicles or workshop.

SUMMARY OF THE INVENTION

The present invention incorporates the realization that a tool holding device for holding and organizing smaller tools and materials in conjunction with such large pails or buckets would be advantageous to those involved in the construction industry. Accordingly, one aspect of the present invention provides a fixture which is adapted for connection to a large empty pail or bucket to hold tools or materials about the perimeter of the pail or bucket or at the upper end of the cylindrical interior space. The adaptability of this tool holding fixture for use with empty pails or buckets which are easily obtained by contractors and already in wide use thereby facilitates the purposes underlying the present invention.

One embodiment of the present invention provides a tool bucket organizer adapted for use in connection with a cylindrically shaped bucket, the tool bucket organizer being in the form of a generally planar platform member having a circular aperture in the central region thereof for cooperative alignment with the opening of the bucket, the perimeter of said circular aperture being adapted for cooperative engagement with the rim of the bucket so that said platform member forms a flange-like configuration about the perimeter of the bucket wherein holes, hooks, and other contrivances are provided for holding tools about the perimeter of the bucket or in the upper region of the bucket, the platform member further including slot means for the bail of the bucket to extend therethrough and at least one portion of the flange-like configuration being proximate to the rim of the bucket to facilitate the ease with which the tool bucket and tool bucket organizer can be carried. The tool bucket organizer can be made and used with or without a cover member which can be hinged to the proximal portion of the platform member and include a latch for connection to the portion of the platform member opposite the hinge members and a handle so that the tool bucket and tool bucket organizer can be carried in the covered position.

In accordance with another embodiment of the present invention, an annular chamber is provided at the lower end of the pail or bucket, this tool or material organizer having several compartmentalized and covered bins for holding nails, electrical tape, solder, copper pipe joints, or the like. This chamber can be fastened to the bottom portion of the bucket in any suitable manner or, in accordance with another embodiment of the present invention, can be coupled to the platform member of the tool bucket organizer to secure the same in assembled position. This tool or material organizer serves as a stabilizing base for the tool bucket as well as a storage bin.

Accordingly, it is an object of the present invention to provide a tool bucket organizer for use in connection with an empty pail or bucket of the type customarily used by contractors to carry tools and materials.

It is another object of the present invention to provide a tool bucket organizer adapted to hold tools in easily accessible positions either about the perimeter of the bucket or in the upper region of the interior space of the bucket.

It is another object of the present invention to provide an annular chamber for disposition about the lower peripheral region of the bucket for holding smaller tools and materials, as well as providing a stabilizing base for the tool bucket.

These and other objects will become apparent, as will a better understanding of the concepts underlying the present invention, by reference to the following description which is to be taken in conjunction with the accompanying drawings.

DETAILED DESCRIPTION OF THE INVENTION

Figure 1:
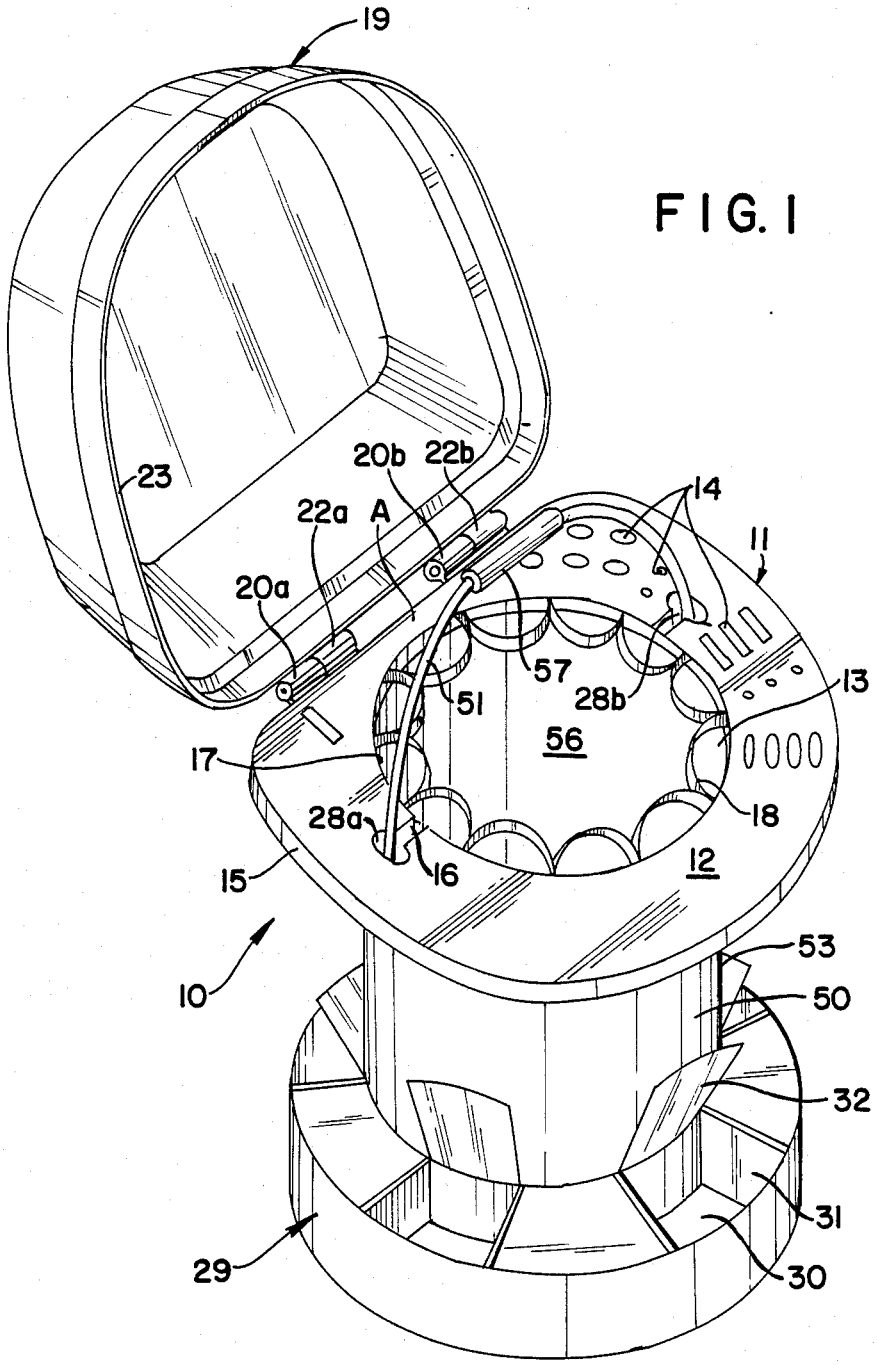
FIG. 1 is a perspective view of the tool bucket organizer in accordance with one embodiment of the present invention wherein the same is in assembled position on an empty bucket.

Referring to the drawings, FIGS. 1–4 illustrate the preferred embodiments of the tool bucket organizer generally designated as 10 in accordance with the present invention.

Figure 3:
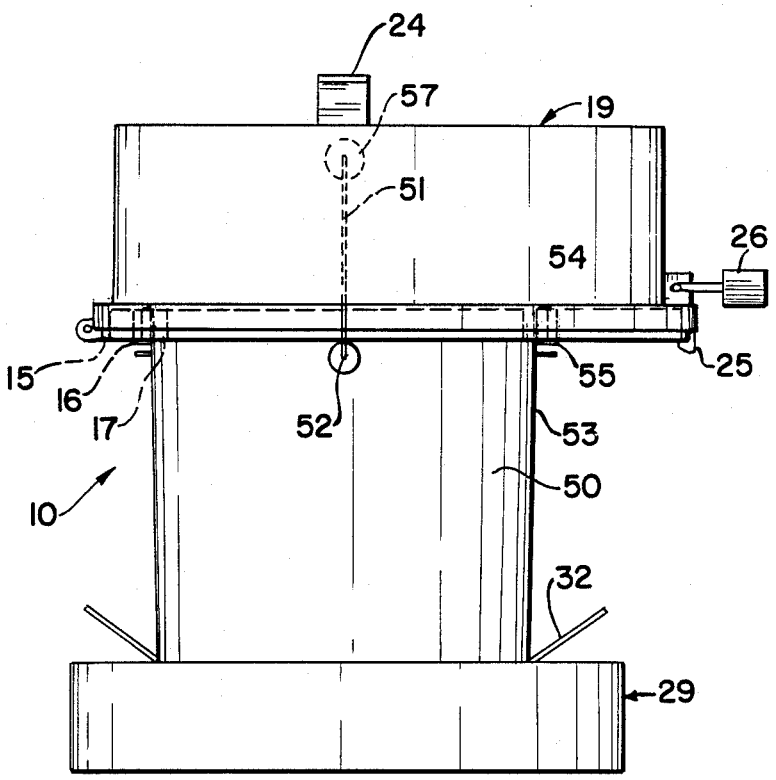
FIG. 3 is a left side view of the tool bucket organizer shown in FIG. 1 wherein the cover member is shown in the closed and latched position on the platform member.

The tool bucket organizer 10 includes a platform member 11 having a generally planar surface 12 and a circular aperture 13 for cooperative alignment with the opening of the bucket. The planar surface 12 comprises a flange-like configuration about the perimeter of the bucket and has a plurality of variously shaped holes therethrough for receiving and holding various tools and materials. Platform member 11 includes a peripheral flange 15 to add strength to the platform member 11 which is preferably formed of a thin plastic material. Similarly, flanges 16 and 17, shown in FIG. 3, are provided about the perimeter of circular aperture 13 for adding stability to the platform member 11, but more importantly, for defining an annular channel for cooperatively engaging the rim of the bucket. Disposed on the interior surface of flange 17 are a plurality of loop members 18 for receiving and holding various tools and materials in the upper region of the interior space of the bucket.

Figure 2:
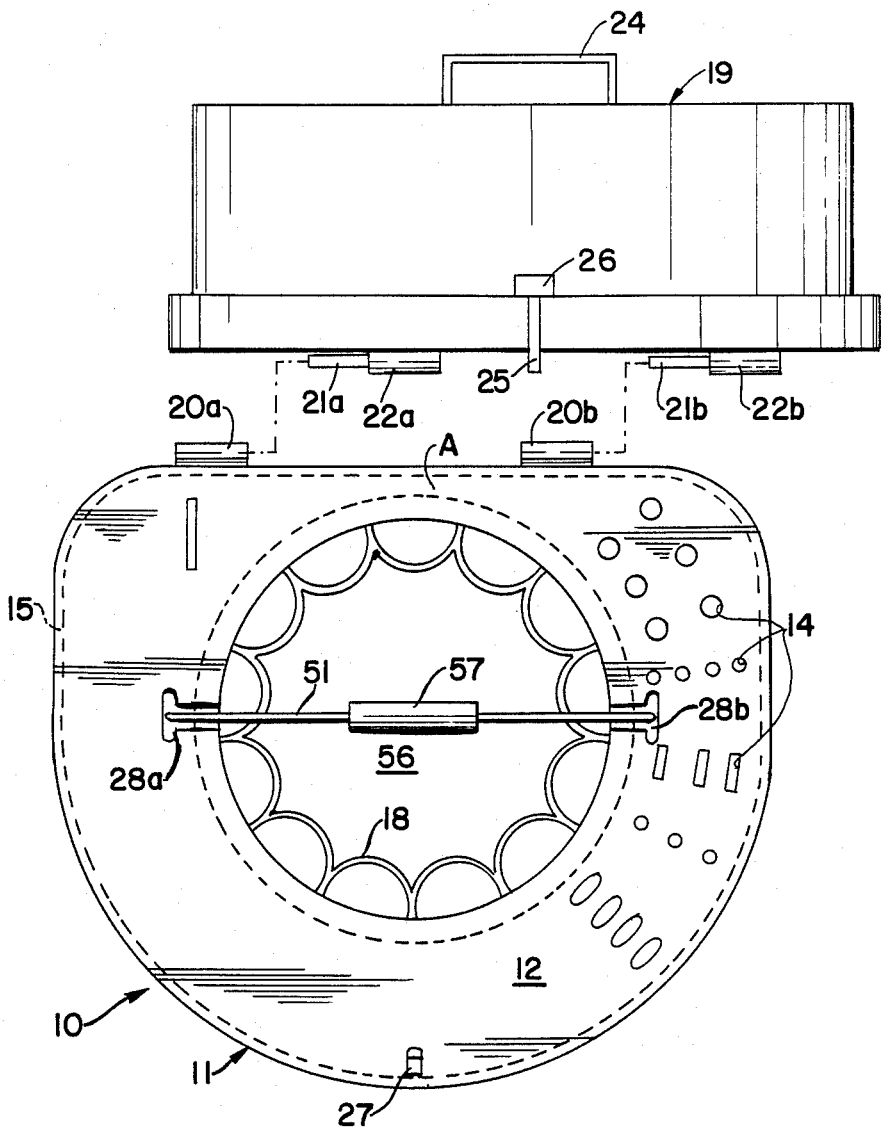
FIG. 2 is a top, plan view of the tool bucket organizer shown in FIG. 1 wherein the cover member is shown in its removed position from the platform member of the tool bucket organizer.

The tool bucket organizer 10 further includes cover member 19 which is pivotably connected to platform member 11 by means of hinge members 20*a* and 20*b* on platform member 11 which have longitudinal passages for receiving hinge pins 21*a* and 21*b* of hinge members 22*a* and 22*b* which are connected to cover member 19. Cover member 19 includes wall members 23 to define an interior space in which the various tools and materials held in platform member 11 and the bail of the bucket will be disposed when cover member 19 is in the assembled or closed position, as shown in FIG. 3. FIGS. 2 and 3 show handle member 24 and latch member 25 which is actuated by lever 26. Latch member 25 is adapted for cooperative engagement with latch receiving means 27 on the side of platform member 11 opposite from hinge members 20*a* and 20*b*, thereby removably connecting cover member 19 to platform member 11 and releasably retaining the cover in closed position relative to the platform member. Thus, tool bucket organizer can be carried by handle member 24.

The tool bucket organizer 10 is readily usable in conjunction with a bucket of the type shown in the drawings and generally designated as 50 and having a bail 51 pivotably connected at 52 to the walls 53 which include an annular rim 54-and annular flange means 55 at the upper end thereof on which flanges 16 and 17 might rest. Bucket 50 further includes an interior space 56 and a rotatable handle member 57.

Thus, platform member 11 includes slot means 28*a* and 28*b* located on either side of circular aperture 13 for bail member 51 to extend therethrough. It is important to note that slot means 28*a* and 28*b* are shaped so that bail 51 can be pivotably moved to a resting position on platform member 11 (not shown) so that the tools stored in the interior space 56 of bucket 50 can be easily removed therefrom.

Platform member 11 is secured to bucket 50 by means of glue in the annular channel defined by flanges 16 and 17. Of course, platform member 11 can be secured to bucket 50 in any suitable manner, such as screws, nails, snap-on arrangement or the like, including as described below with respect to further embodiments.

The width of the flange-like configuration of platform member 11 is substantially equal on three sides of bucket 50, the fourth side, generally designated as A, being relatively narrow so that peripheral flange 15 is proximate to annular rim 54 of bucket 50. This configuration permits a contractor using a bucket equipped with tool bucket organizer 10 to more easily carry the same as the flange formed by platform member 11 will not interfere with the contractor's legs as he walks. Thus, the contractor can hold the bucket and bucket organizer closer to his body thereby exerting less energy in carrying the same.

The tool bucket organizer 10 includes an annular tool and material chamber 29 disposed about the lower portion of bucket 50 and including bins 30 compartmentalized by partitions 31 and covered by hinged covers 32. Of course, tool and material chamber 29 can be affixed to bucket 50 in any suitable manner including fasteners through the side walls 53 of bucket 50 or, if tool and material chamber 29 includes a bottom portion, fastened to the bottom of bucket 50.

Tool and material chamber 29 serves a dual purpose in connection with the present invention; namely, providing storage bins 30 for holding the carpenter's nails or tacks, the plumber's solder or copper joints, the electrician's solder or wire nuts, or any other implements and materials used by those involved in the construction industry, and providing stability for the platform member 11 whereby the tool and material chamber 29 provides a relatively large base so that in the event that heavier tools are inadvertently placed on one side of platform member 11, bucket 50 will not overturn.

Figure 4:
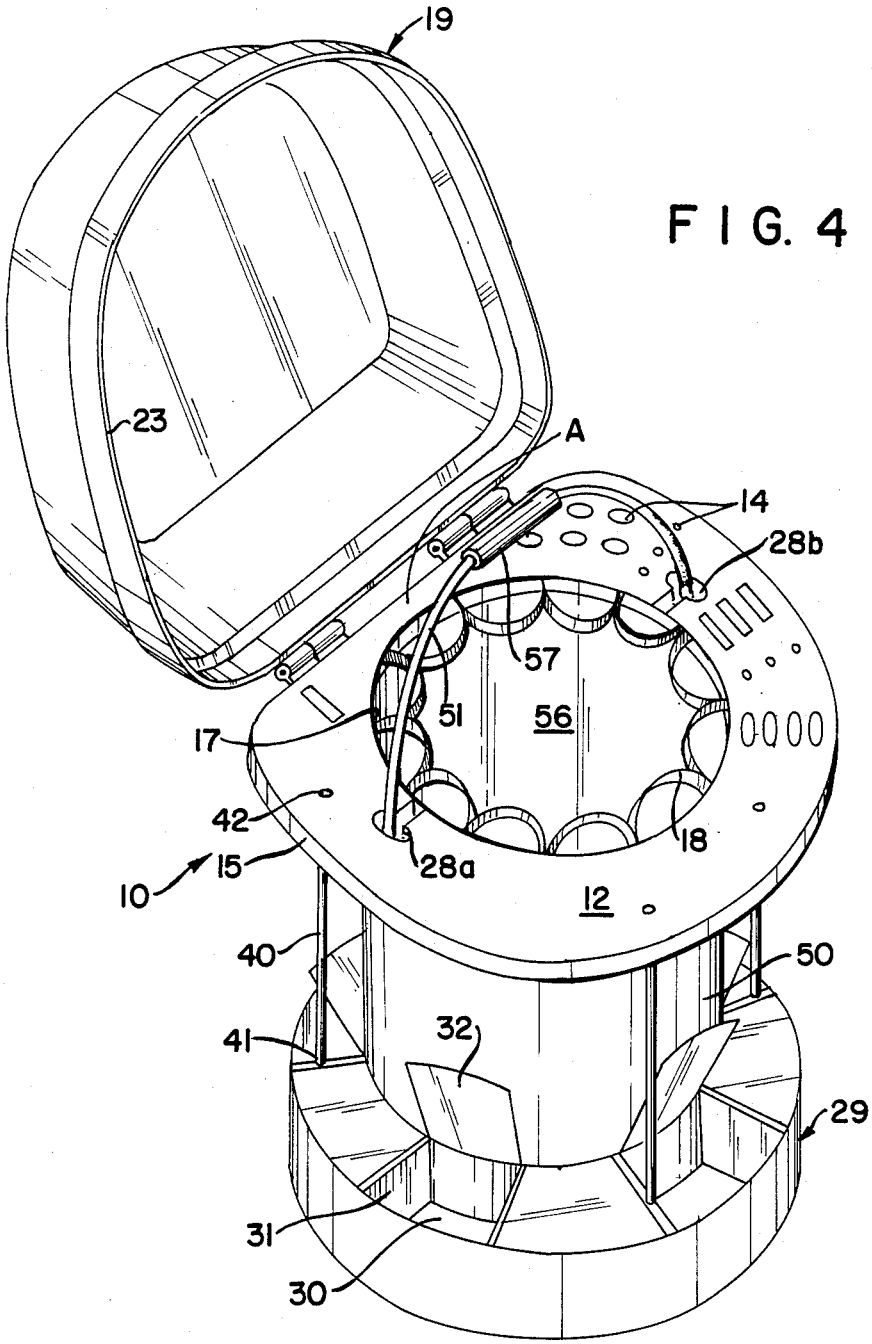
FIG. 4 is a perspective view of a tool bucket organizer in accordance with a second embodiment of the present invention wherein the tool and material chamber at the lower end of the bucket is secured to the platform member of the tool bucket organizer.

Another embodiment of the present invention is shown in FIG. 4 of the drawings, in which the same reference numerals utilized in the preceding Figures are utilized to reference similar elements. In this embodiment, annular chamber 29 and platform member 11 are secured to bucket 50 by means of strut members 40 which are fixed to tool and material chamber 29 as at 41 and fixed to platform member 11 as at 42, at four equidistant locations about the peripheral area of bucket 50. Annular chamber 29 has a bottom member which acts upon the bottom of bucket 50 when strut members 40 are tightened in assembled position thereby effecting an equal and opposite force on annular rim 54 of bucket 50 by the channel defined by flanges 16 and 17 of platform member 11. Thus, in effect, platform member 11 and annular chamber 29 clamp bucket 50 therebetween. It should be noted that in this embodiment, platform member 11 need not be secured to annular rim 54 of bucket 50 by glue, screws, or the like, as this clamping action will secure the same in assembled position.

A last embodiment of the present invention, the details of which are easily described and can be gleaned from FIGS. 1–4, relates to integrally forming bucket 50 with annular chamber 29. In this manner, platform member 11 can be secured to bucket 50 by any suitable securing means in accordance with the first embodiment or by strut members in accordance with the second embodiment. Of course, integral formation of platform member 11 with bucket 50 is also contemplated by the present invention.

Thus, a tool bucket organizer for use in connection with readily discarded pails or buckets has been described, this tool bucket organizer conferring the advantages of inexpensive modification of a customarily used tool carrying device in which tools and materials can be efficiently organized and held in an easily accessible fashion, and which can be easily carried by an individual.

While the foregoing description and Figures illustrate the preferred embodiments of the tool bucket organizer in accordance with the present invention, it should be appreciated that certain modifications may be made in the structure and operation of the disclosed embodiments without departing from the spirit and scope of the present invention as defined by the claims which are set forth immediately below.

What is claimed is:

1. A tool bucket organizer for use with a bucket having bucket wall structure defining a top, a bottom and an open mouth at the top and having a bail connected to said bucket wall structure, said tool bucket organizer comprising a platform member having an aperture for providing access to the interior of said bucket, means for securing said platform member to the top of said bucket, so that said aperture is aligned with the mouth of the bucket and so that the bail of the bucket protrudes upwardly beyond said platform member, and means for holding at least one tool in engagement with said platform member.

2. The tool bucket organizer as claimed in claim 1 wherein said platform member protrudes radially outwardly from the periphery of the bucket when said platform member is secured to the bucket, the extent of such protrusion being unequal around the periphery of the bucket so that at least one side of said platform member is in relatively close proximity to the periphery of said bucket so as to facilitate the carrying of said bucket.

3. The tool bucket organizer as claimed in claim 1 wherein said platform member forms a generally planar flange about the perimeter of said bucket, said holding means including holes in said flange.

4. The tool bucket organizer as claimed in claim 1 wherein said tool holding means includes at least one loop member protruding into said aperture of said platform member.

5. The tool bucket organizer as claimed in claim 2 wherein said platform member includes two flange members about the periphery of said aperture to define a channel for receiving the rim of the bucket when said platform member is secured to said bucket.

6. The tool bucket organizer as claimed in claim 2 including a cover member hingedly connected to said platform member.

7. The tool bucket organizer as claimed in claim 6 wherein said cover member includes a handle member, the organizer further comprising a latch means for releasably securing said cover member against movement relative to said platform member.

8. A tool bucket organizer as claimed in claim 1 wherein said platform means includes a pair of slots arranged so that said bail protrudes upwardly through said slots when said platform means is secured to the bucket.

9. A tool bucket organizer as claimed in claim 1 further comprising an annular tool and material chamber and means for connecting said chamber to the lower end of said bucket.

10. A tool carrier comprising a bucket and an organizer as claimed in claim 1 secured thereto.

11. A tool carrier as claimed in claim 10 wherein said platform means of said organizer is integral with said wall structure of said bucket, said securing means including the integral connection between said platform means and said wall structure.

12. A tool carrier as claimed in claim 10 wherein said annular tool and material chamber is integral with said wall structure of said bucket, said securing means including the integral connection between said platform means and said wall structure.

* * * * *